US006305130B1

(12) United States Patent
Ackerman, Jr.

(10) Patent No.: US 6,305,130 B1
(45) Date of Patent: Oct. 23, 2001

(54) WINDOW FLASHING

(76) Inventor: Dale Stanley Ackerman, Jr., 2319 Federal Ave. E., Seattle, WA (US) 98102

( * ) Notice: Subject to any disclaimer, the term of this patent is extended or adjusted under 35 U.S.C. 154(b) by 0 days.

(21) Appl. No.: 09/567,866

(22) Filed: May 9, 2000

(51) Int. Cl.[7] ..... E06B 7/14
(52) U.S. Cl. ..... 52/58; 52/62
(58) Field of Search ..... 52/302.6, 58, 59, 52/60, 208, 209, 97, 62

(56) References Cited

U.S. PATENT DOCUMENTS

| | | | | |
|---|---|---|---|---|
| 1,233,536 | | 7/1917 | Adams . | |
| 1,338,403 | | 4/1920 | Stark . | |
| 1,636,365 | | 7/1927 | Hokanson . | |
| 1,750,526 | | 3/1930 | Knox . | |
| 3,405,485 | * | 10/1968 | Edwards | 52/300 |
| 3,442,055 | | 5/1969 | Posey . | |
| 4,485,600 | | 12/1984 | Olson . | |
| 4,490,953 | | 1/1985 | Meola . | |
| 4,514,944 | | 5/1985 | Doell . | |
| 5,018,333 | | 5/1991 | Bruhm . | |
| 5,027,572 | | 7/1991 | Purcell et al. . | |
| 5,072,552 | | 12/1991 | Saunder . | |
| 5,218,793 | | 6/1993 | Ball . | |
| 5,377,464 | | 1/1995 | Mott et al. . | |
| 5,381,632 | * | 1/1995 | Damron | 52/58 |
| 6,119,416 | | 9/2000 | Larson . | |
| 6,182,405 | | 2/2001 | Lindahl . | |

* cited by examiner

*Primary Examiner*—Michael Safavi
(74) *Attorney, Agent, or Firm*—Christensen O'Connor Johnson Kindness PLLC

(57) ABSTRACT

A flashing assembly includes an inner lip that fits within a rough opening. Bonded to the inner lip is an outer flange that covers a portion of a wall around a rough opening. An outer flap is bonded to the outer flange and has an adhesive on its inner surface that is covered with a backing material. Once a window or other structure is installed into the rough opening, the backing material is removed and the cover flap is secured over a nailing flange. In one embodiment of the invention, the flashings are formed as L-shaped sections that may be fitted in virtually any rough opening by varying the amount of overlap on the L-shaped pieces. In an alternative embodiment of the invention, the flashing assemblies are straight sections that may be used alone or in combination with the L-shaped sections.

17 Claims, 4 Drawing Sheets

WINDOW FLASHING

FIELD OF THE INVENTION

The present invention relates to building materials in general, in particular to seals for windows.

BACKGROUND OF THE INVENTION

One of the most common failure points where water enters a building's envelope is around windows and doors. Water penetration is one of the most significant factors leading to premature failures of structures. Most windows and doors, whether aluminum or vinyl, are secured in the rough opening by a nailing flange. As an example, the window is placed in the rough opening from the outside and secured using nail fasteners that are driven through the window's nailing flange. Installation methods vary significantly and range from as little as building paper lapping over or under the window flange to flashing materials being shingled in the rough opening prior to window installation, application of caulking installed from a tube caulk gun under the window flange and various flashing or adhesive tapes applied over the window flange. Installation is often performed from ladders or scaffolding at various levels above the ground. Flashing materials are often misaligned or applied in an inconsistent manner that leaves wrinkles or voids in the material leading to leaks, i.e., direct water pathways to the underlying building materials. The flashing is assembled from numerous separate components that when installed cover each other making inspection of the completed flashing assembly extremely difficult. Further, since there is often a time lapse between installation of the various components they are often damaged by wind, rain or other mechanical disturbances.

Given these problems, there is a need for an improved method of ensuring a weather-tight barrier for window installations.

SUMMARY OF THE INVENTION

The present invention is a window flashing assembly that includes an inner lip that fits within the interior surface of a rough opening. Bonded to the inner lip is an outer flange that covers a portion of the wall surrounding the rough opening. The outer flange has an outer flap having an adhesive material on its inside surface. The adhesive is preferably covered with a backing material. A seal may be placed around the outer flange to engage the rear surface of a nailing flange.

Upon placing the window into the rough opening, the backing material is removed and the outer flap is adhesively secured over a nailing flange on the window in order to provide a water-tight seal.

In one embodiment of the invention, the window flashing assembly is formed as L-shaped sections that can be fitted into a variety of rough opening sizes by varying an amount of overlap of the L-shaped sections. In an alternative embodiment of the invention, the window flashing assembly is formed as straight sections that can be used alone or in combination with the L-shaped sections to fit within differently sized rough openings.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION OF THE PREFERRED EMBODIMENT

Figure 1:
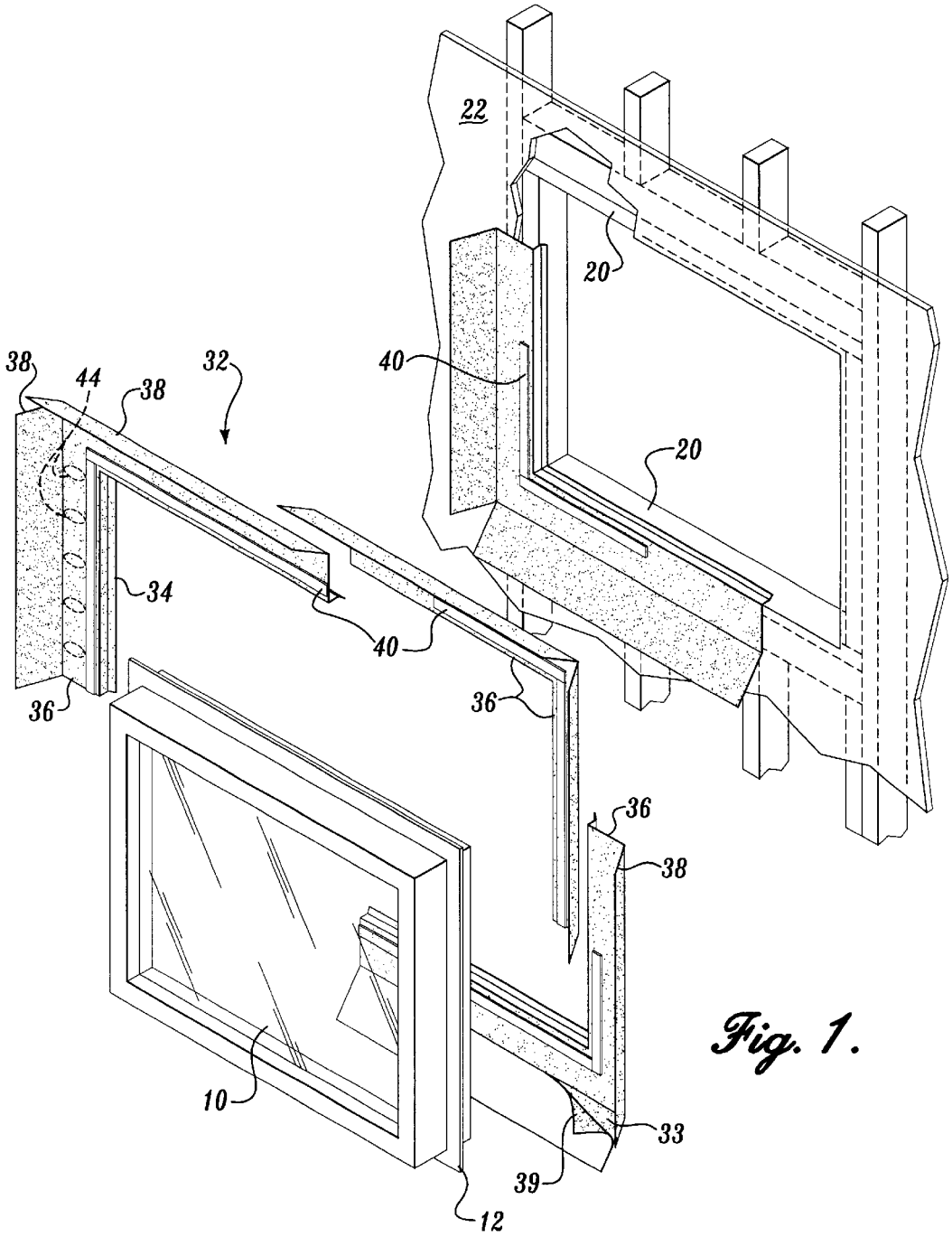
FIG. 1 illustrates a window flashing assembly in accordance with one embodiment of the present invention.

The present invention is a window flashing assembly that provides an improved barrier to weather. As shown in FIG. 1, a window 10 is to be installed in a rough opening 20 that is formed within a wall 22. The window 10 has a nailing flange 12 that surrounds its perimeter through which one or more fasteners are inserted in order to secure the window 10 into the rough opening 20.

To prevent moisture from seeping in behind the nailing flange 12, a series of flashing assemblies 32 is placed into the rough opening 20 prior to the installation of the window 10. Each flashing assembly 32 has an inner lip 34 that covers at least a portion of an inner surface of the rough opening. The inner lip 34 is seamlessly joined with an outer flange 36 that covers a portion of the exterior of the wall 22 surrounding the rough opening 20. Bonded to the outer edge of the flange 36 is an outer flap 38 that is folded over the nailing flange 12 of the installed window to form a watertight seal.

In the presently preferred embodiment of the invention, each of the flashing assemblies 32 is formed as an L-shaped section having two legs that meet at approximately 90°, such that there are no seams in the corners of rough opening 20. With an L-shaped flashing assembly installed into each corner of the rough opening, the legs overlap by varying amounts depending on the dimensions of the rough opening. Although the flashing assemblies are preferably designed for square or rectangular windows, it will be appreciated that the present invention could be used to seal differently shaped windows, such as circular, octagonal, etc. In addition, the flashing could also be used with other structures such as doors or other areas where water damage is likely.

Figure 2:
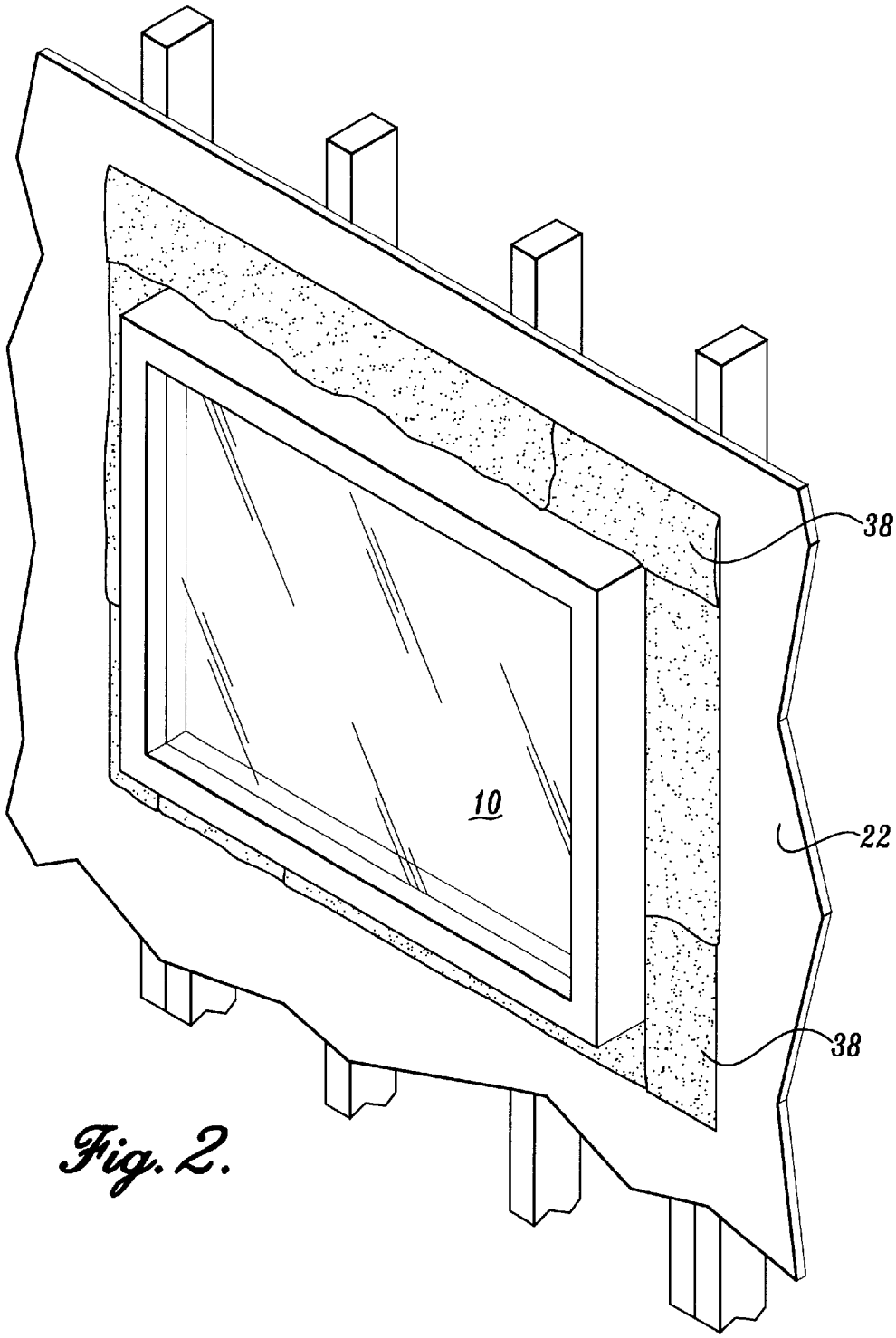
FIG. 2 illustrates how the window flashing assembly shown in FIG. 1 is installed to form a weather-tight seal around a window.

FIG. 2 illustrates the installation of the window 10 in the wall 22 when the outer flaps 38 have been sealed over the nailing flange. The outer flaps 38 preferably have an adhesive 33 covering their inner surface. The adhesive is covered with a removable backing material 39 (FIG. 1) that is pulled away from the adhesive prior to covering the nailing flange. The outer flaps 38 are preferably folded over the nailing flange beginning with the bottom of the window followed by the sides, and finally the top such that the outer flaps 38 are shingled over the nailing flange so that any water that meets the flange will be directed away from the rough opening.

Figure 3:
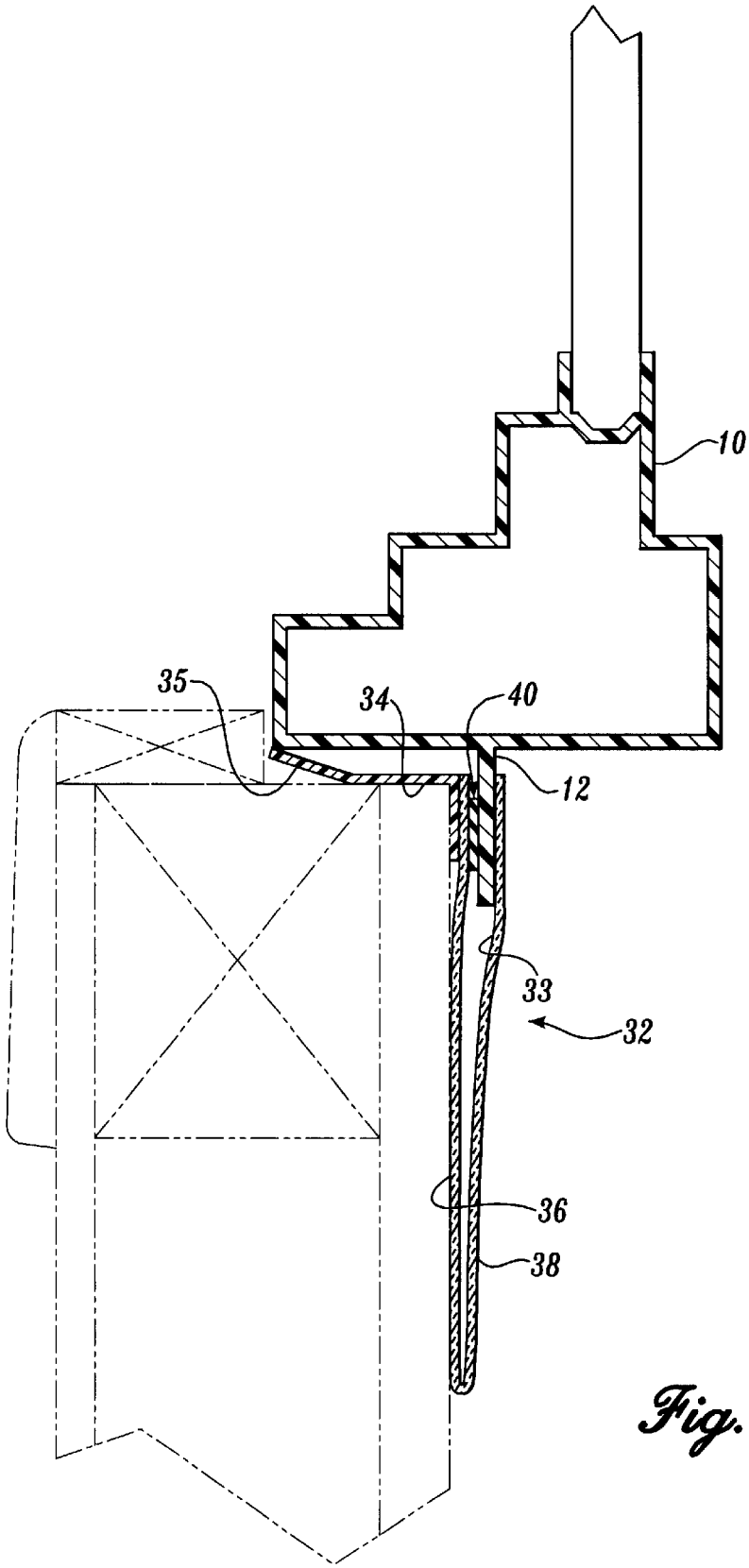
FIG. 3 is a cross-sectional view of a window flashing assembly according to the present invention.

FIG. 3 shows a cross-sectional view of a flashing assembly 32 installed in a rough opening 20. As indicated above, each flashing assembly 32 includes an inner lip 34 that fits within the interior surface of the rough opening and aids in the proper alignment of the flange in the opening. The inner lip 34 may have a slightly raised portion that forms a water dam 35 at the inner edge of the lip 34. The water dam 35 ensures that any water that does manage to get behind the nailing flange 12 of the window is directed towards the exterior surface of the wall.

Seamlessly bonded to the inner lip 34 is the outer flange 36 that covers a portion of the wall surrounding the rough opening 20. When installed, the nailing flange of the window lies over a portion of the outer flange 36. The outer flange 36 is preferably made of a vinyl or other waterproof flexible materials and may include one or more stiffening members (44 as shown in FIG. 1) to add strength. The outer flange 36 also includes an outer flap 38 along its outer edge. The outer flap 38 has an adhesive on its interior surface. As indicated above, once the window 10 is installed into the rough opening, a backing layer over the adhesive is removed and the outer flap 38 is folded over the nailing flange 12 in order to provide a waterproof seal such that the nailing flange 12 is sandwiched between the outer flange 36 and the outer flap 38.

In addition, the window flashing assembly 32 may include a weather strip 40 disposed on the outer flange 36 around the rough opening such that when the window is installed into the rough opening the weather strip 40 engages the inner surface of the nailing flange 12. The weather strip 40 provides a further barrier to moisture.

Figure 4:
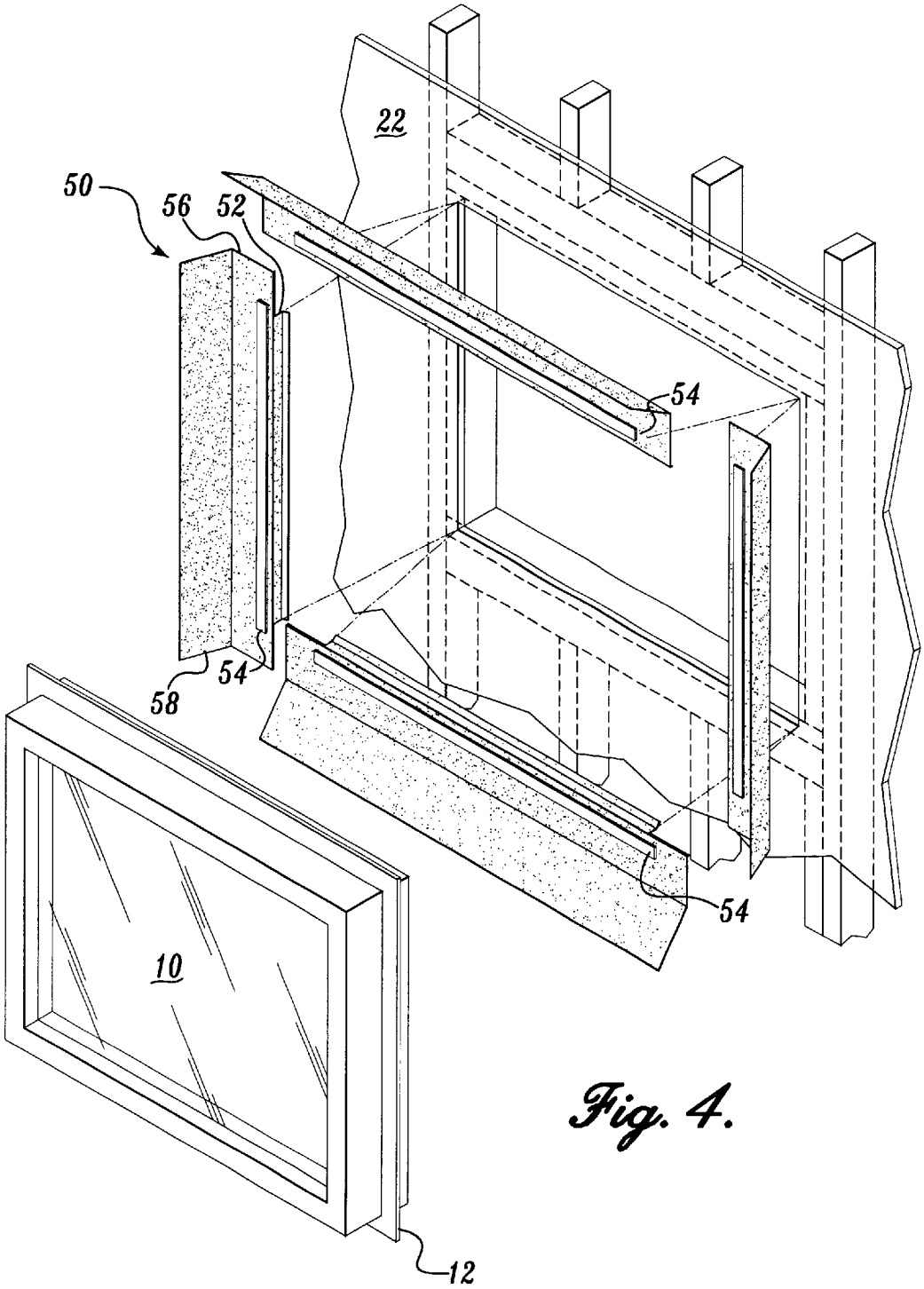
FIG. 4 illustrates a window flashing assembly according to a second embodiment of the present invention.

FIG. 4 shows an alternative embodiment of the present invention. As opposed to the embodiment shown in FIGS. 1 and 2, a window flashing assembly 50 is formed as a straight section rather than the L-shaped section. The straight window flashing sections 50 can be used alone in order to seal a window in a rough opening. Alternatively, the flashing assemblies 50 can be used in combination with the L-shape flashing assemblies in order to extend the size of a window that can be sealed.

As with the previously disclosed embodiment, the window flashing 50 assembly includes an inner lip 52 that fits within the inner surface of a rough opening. An outer flange 56 is seamlessly bonded to the inner lip 52 and covers a portion of the wall 22 surrounding the rough opening. Bonded to the outer edge of the outer flange 56 is an outer flap 58 having an adhesive on its inner surface that is covered with a backing material. Once the window 10 is installed in the rough opening 20, the backing material is removed and the outer flap 58 is secured over the nailing flange 12 of the window 10. In addition, the flashing assembly may include a weather strip 54 near the junction of the inner lip 52 and the outer flange.

As can be seen from the above, the present invention provides a simple and convenient mechanism for improving the seal of windows.

While the present invention has been described with respect to its preferred embodiments, those skilled in the art will recognize that various changes may be made without departing from the scope of the present invention. It is therefore intended that the scope of the invention be determined solely from the following claims and the equivalents thereto.

The embodiments of the invention in which an exclusive property or privilege is claimed are defined as follows:

1. A system for sealing a window within a rough opening in a wall, comprising:

a number of flashing assemblies that are installed into the rough opening prior to placing the window in the rough opening and that seal the window, each assembly including:

an inner lip having a raised water dam that fits within the rough opening;

an integrally formed outer flange extending from the inner lip and covering a portion of the wall that surrounds the rough opening;

an integrally formed adhesive outer flap that folds back over the outer flange such that the flap seals a nailing flange of a window between the exterior surface of the outer flange and an inside adhesive surface of the outer flap.

2. The system of claim 1, wherein the flashing assemblies are substantially straight.

3. The system of claim 1, wherein the flashing assemblies are angled at 90° to fit within a corner of the rough opening.

4. The system of claim 1, wherein the outer flange includes a weatherstrip that is positioned to be behind a flange of a window installed in the rough opening.

5. A window flashing assembly for sealing a window within a rough opening of a wall, comprising:

an inner lip that lines an interior surface of the rough opening, the inner lip including a raised water dam that directs moisture toward an exterior of the rough opening;

an integral outer flange that extends outwardly from the inner lip and covers a portion of the wall that surrounds the rough openings;

an integral outer flap that is foldable back over a nailing flange of a window placed in the rough opening such that the nailing flange is sealed between the outer flange of the window flashing assembly and the outer flap.

6. The window flashing assembly of claim 5, further comprising a weather strip disposed on the outer flange such that the weather strip is positioned behind the nailing flange of a window placed in the rough opening.

7. The window flashing assembly of claim 5, wherein the flashing assembly is L-shaped.

8. The window flashing assembly of claim 5, wherein the outer flap has an adhesive on its inner surface to adhesively secure the window flange of an installed window between the outer flange of the flashing assembly and the outer flap.

9. A system for sealing a window in a rough opening in a wall, comprising:

a number of flashing assemblies, each of which includes:

an inner lip that fits within the rough opening;

an integral outer flange that extends from the inner lip and covers a portion of the wall surrounding the rough opening;

an integral outer flap extending from an outside edge of the outer flange and is foldable back over the outer flange;

wherein the flashing assemblies may be overlaid at the corners of the rough opening such that the outer flanges of adjacent flashing assemblies can be shingled over each other and the outer flaps of adjacent flashing assemblies can be shingled over each other when the outer flaps are folded back.

10. The system of claim 9, wherein the inner lip of each flashing assembly includes a water dam that directs moisture out of the rough opening.

11. The system of claim 9, wherein the outer flange of each flashing assembly includes a weather strip.

12. The system of claim 9, wherein the outer flange has an adhesive on its inner surface that adhesively secures the outer flange to a flange of an installed window.

13. A window flashing assembly for sealing a window within a rough opening comprising:

an inner lip that fits within the inner surface of the rough opening;

an outer flange integrally formed with the inner lip, which extends from the inner lip and covers a portion of a wall surrounding the rough opening;

an outer flap integrally formed with the outer flange, which is foldable over a flange of the window to sandwich the window flange between the outer flange of the flashing assembly and the outer flap.

14. The window flashing assembly of claim 13, wherein the outer flap has an adhesive on its inner surface to adhesively secure the window flange of an installed window between the outer flange of the flashing assembly and the outer flap.

15. The window flashing assembly of claim 13 further comprising a weather strip that is positioned along a length of the outer flange.

16. The window flashing assembly of claim 13, wherein the flashing assembly is L-shaped having two legs that meet at approximately 90°.

17. The window flashing assembly of claim 13, wherein the inner lip includes a water dam.

* * * * *